US005335528A

United States Patent [19]

Cristiani

[11] Patent Number: 5,335,528

[45] Date of Patent: Aug. 9, 1994

[54] RAPID LOADING SHORT-STROKE EXTRUSION PRESS, AND PROCESS

[75] Inventor: Giancarlo Cristiani, Gorizia, Italy

[73] Assignee: Techint-Compagnia Tecnica Internazionale S.p.A., Milan, Italy

[21] Appl. No.: 970,492

[22] Filed: Oct. 22, 1992

[30] Foreign Application Priority Data

Oct. 30, 1991 [IT] Italy ..... MI91 A 002886

[51] Int. Cl.[5] ..... B21C 33/00

[52] U.S. Cl. ..... 72/263; 72/270

[58] Field of Search ..... 72/263, 270, 273

[56] References Cited

U.S. PATENT DOCUMENTS 2,188,076 1/1940 Dinzl ..... 72/270
2,751,076 6/1956 Lombard ..... 72/270
3,119,493 1/1964 Zilges .
3,345,854 10/1967 Gross .
4,326,399 4/1982 Doudet .
4,342,212 8/1982 Sibler .

FOREIGN PATENT DOCUMENTS

WO88/00502 1/1988 PCT Int'l Appl. .
WO88/03066 5/1988 PCT Int'l Appl. .
1122163 7/1968 United Kingdom .

*Primary Examiner*—Lowell A. Larson
*Attorney, Agent, or Firm*—Young & Thompson

[57] ABSTRACT

A billet fed extrusion press comprises a rotating arm (46) on a movable cross member (28). The arm carries a plunger (48) and a billet loader (50) spaced from each other, and can be rotated between a condition in which it brings the plunger into a working position in alignment on extrusion axis (a) of the press and the loader (50) into a billet receiving position on one side of the press, and a condition in which it brings the loader into a billet loading position along the axis (a) of the press and the pusher into a rest position on the said one side of the press.

9 Claims, 6 Drawing Sheets

RAPID LOADING SHORT-STROKE EXTRUSION PRESS, AND PROCESS

The present application relates to the field of extrusion presses for metallic materials. Metal bill eta are fed to such presses and then alone an extrusion axis into an axial cavity of a container located upstream of an extrusion die; the billets are pushed across the container cavity and extruded across a die, holded in a die holder slide by means of an extrusion stem or plunger. In particular but not exclusively, the application concerns presses for aluminium Extrusion presses are already known which belong to two main types: "long stroke" presses and "short stroke" presses.

In the long stroke presses the plunger has a stroke length almost equal to the length of the billet plus the length of the container; the plunger is joined rigidly to the press ram, which moves it in a horizontal direction. The billet is brought onto a position between the plunger and the container, with its axis aligned with the extrusion axis the plunger being at a retracted position.

Then the plunger moves forward, pushes the billet inside the container, and extrudes the billet through the die. At the end of the extrusion stroke the plunger returns to a completely retracted position, while the container moves away from the die holder slide, clearing a space for a cutter blade, which comes down from above and separates the billet tail part from the die holder slide.

After the cutting operation, the container moves again to abut against the die holder slide; it is only at this point that the space is created between the container and the extrusion stem which is necessary for loading the next billet to begin the cycle once more.

Such presses have the obvious drawback of being very bulky longitudinally and of having relatively long working times.

Recently various types of short stroke presses have been worked out. In these presses, the plunger or extrusion stem has a transverse movement between a working position on the extrusion axis of the press and a rest position parallel and spaced from the said axis, and the billet is pushed into the container by an auxiliary device, then the plunger is brought onto the extrusion axis for carrying out extrusion.

In a first type of short-stroke presses, the plunger and the billet are subject to vertical shifting. Said presses have various drawbacks: in the first place problems of synchronization of the movements of the parts; further excess lubrication of the dummy block runs inside the machine, causing a danger of fire; furthermore the maintenance operations of the pusher must be performed by getting inside the machine, which is very inconvenient and time-wasting. Finally, the thrust caused on the plunger is discharged onto the vertical guides of the plunger-holder slide, creating various problems, for example wear.

In a second type of short-stroke presses the plunger and the billet are subject to horizontal traverse; when the plunger is aligned on the extrusion axis of the apparatus and acting on a first billet in the container cavity, a second billet is brought into a position at one side of the apparatus; when the second billet is brought on the extrusion axis of the apparatus in order to be pushed into the container, the extrusion stem is brought into a position on the other side of the apparatus. In this type of press the operator is usually on the side of the apparatus where the billets are loaded and has to reach the other side to carry out the maintenance of the plunger, which involves loss of time and consequently reduced speed of operation; or it becomes necessary to use a second operator on the press. In addition the toothed member which operates the movement of the plunger and of the billet is subject to knocks against its teeth, which limit its working life.

A third type of short-stroke extrusion press (PCT/EP 87/00591) is provided with a plunger-holder slide capable of a horizontal traversing movement, while the billets are loaded by means of an independent loader. However this is a relatively slow device and increases the working times of the press. Furthermore, as in the previous cases, the thrust on the plunger is discharged onto the traversing slide, which is in itself a moving member, with all the drawbacks involved.

Finally PCT/US 87/01725 discloses an indirect extrusion press wherein a ram mounted turret supports a pressing stem and a piercing stem. Said press is aimed at solving problems different from the problems solved by this invention, does not mention any billet loading system and does not give any useful teaching in the direction of this invention.

The aim of this invention is to realize an extrusion press of the short stroke type which will avoid the drawbacks involved with the previous systems and function with very short working times, be easy to maintain, and be sturdy and durable.

In particular the new extrusion press comprises, on the usual mobile cross member moved by the press ram, a rotatable pin having its rotation axis parallel to the extrusion axis of the press. The pin supports an arm, which carries a billet loader and an extrusion stem or punch on opposite sides with respect to the axis of the pin. The arm is rotatable between a position in which the plunger is aligned with the extrusion axis and the loader is positioned at one side of the press and projecting from it, and a position in which a billet on the loader is aligned with the extrusion axis and the plunger is positioned along the same side of the apparatus.

In addition, the arm is axially movable between a position in which a foot of the plunger rests on a seat or housing in the mobile cross member of the machine, and a position in which the foot of the plunger is outside the said housing.

Preferably the rotating movement is given to the pin through a rack and crown gear system, wherein the rack is movable on the cross member and the pinion is rotationally integral with the pin, and the axial movement is given to the pin by means of a cylinder which is integral with the mobile cross member or integrated in the pin.

The billet is pushed into the container by means of a low pressure device (pusher).

According to the invention in a preferred embodiment, a billet is loaded onto the billet loader (which is at its position on the side of the press) while the loader is moving integrally with the punch in its working and/or return stroke, the billet being transferred to the loader by a carriage moving in synchronism.

The new apparatus and process have some important advantages when compared with the previous apparatuses and overcomes the drawbacks thereof.

With respect to long stroke presses, with a same length of machine, the billet to be extruded can be substantially longer. With a same length of billet a machine can be made which is substantially shorter. The dead times are greatly reduced, both because loading the billets is accelerated and because it is no longer necessary to wait for the container to close before loading the next billet. With some traditional systems, the billet is inserted into the container by means of the plunger which is driven by the main cylinder. If the billet is in the wrong position, however quickly the operator may act, the large masses involved cause the billet to jam and buckle, leading to the machine standing still for long intervals. With the new system the billet is inserted into the container with a low pressure system, which is not sufficient to buckle the billet should it jam.

With respect to the previous short stroke presses, the plunger is outside the press on the operator side during the phase when the billet is inserted into the container, thus making the lubrication operation of the dummy block of the plunger extremely simple, within a time included in the loading cycle of the billet. In this way working times are cut down further.

In addition thrust is given to the plunger directly by the mobile cross member, which is a member whose size and structure are designed to withstand conditions of high stress.

Exemplary unrestrictive embodiments of the invention are described below in detail, with reference to the appended drawings, in which.

Figure 1:
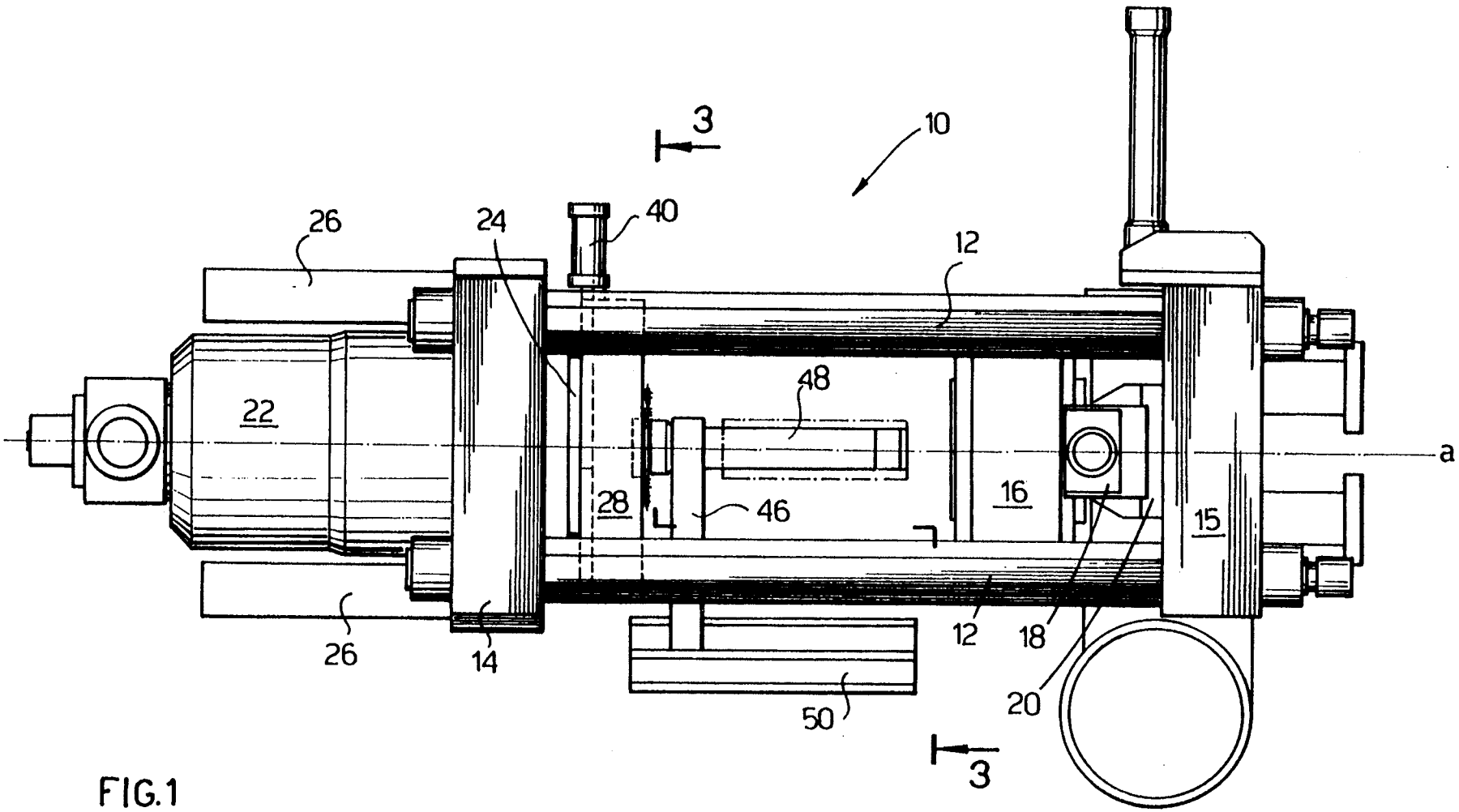
FIG. 1 is a plan view of an extrusion press according to the present invention, on a reduced scale.

An extrusion press, in particular a forward extrusion press, is illustrated in the drawings and referenced 10 as a whole. It comprises a fixed structure, which comprises four horizontal columns 12 and vertical mounts 14 and 15, already known in themselves. It also comprises a container 16 of a well-known type, a cutter 18 and a die holder slide 20 downstream of the container, these elements also being of a well-known type. Furthermore it comprises a cylinder 22 and relative main ram 24 for operating a plunger or extrusion stem, and side cylinders 26 for the return movement of the plunger.

The cylinder 22, ram 24, container cavity (not shown) are aligned along extrusion axis a.

The ram 24 acts on a mobile cross member 28 which is movable longitudinally guided by the columns 12.

The mobile cross member or beam 28 has a hole 30 which receives a bush 32 in a rotatable way around an axis b parallel to said axis a. The bush 32 is integral with a crown gear 34, engaging with a rack 36 which is formed on a bar 38 integral with the piston rod of a cylinder 40.

The cylinder 40 is carried on said movable cross member 28 and the rack has a movement which is transverse to the axis a. The bush 32 is rotationally integral with rotation in any known way (for example by means of grooves and longitudinal projections) with a pin 42. This can slide longitudinally for a length inside the bush and therefore with respect to the cross member 28, and revolves around the axis b. The sliding of the pin is effected by means of a cylinder 44 integral with the cross member or integrated in the pin and having its rod 45 integral with the pin. At the opposite end to the cylinder 44, the pin carries in an integral way a transverse arm 46 extending from one and the other part of the axis b. Such arm carries an extrusion stem or plunger 48 on one side of the axis b, and a loader 50 for the billet B on the other side.

The loader is drawn in the form of a cage, but obviously it can be of any shape as long as it allows the billet to come out axially.

The plunger 48 has a head 52 of a well-known type and a foot 54 extending towards the cross member 28. This has a seat or thrust surface 56 for the foot. It also has a through opening 58 aligned along axis a for a low pressure piston or pusher 60 for loading a billet into the container.

A locking device 62 may be provided for locking the plunger foot 54 onto the seat 28, e.g. a pin received in a through hole.

Figure 2:
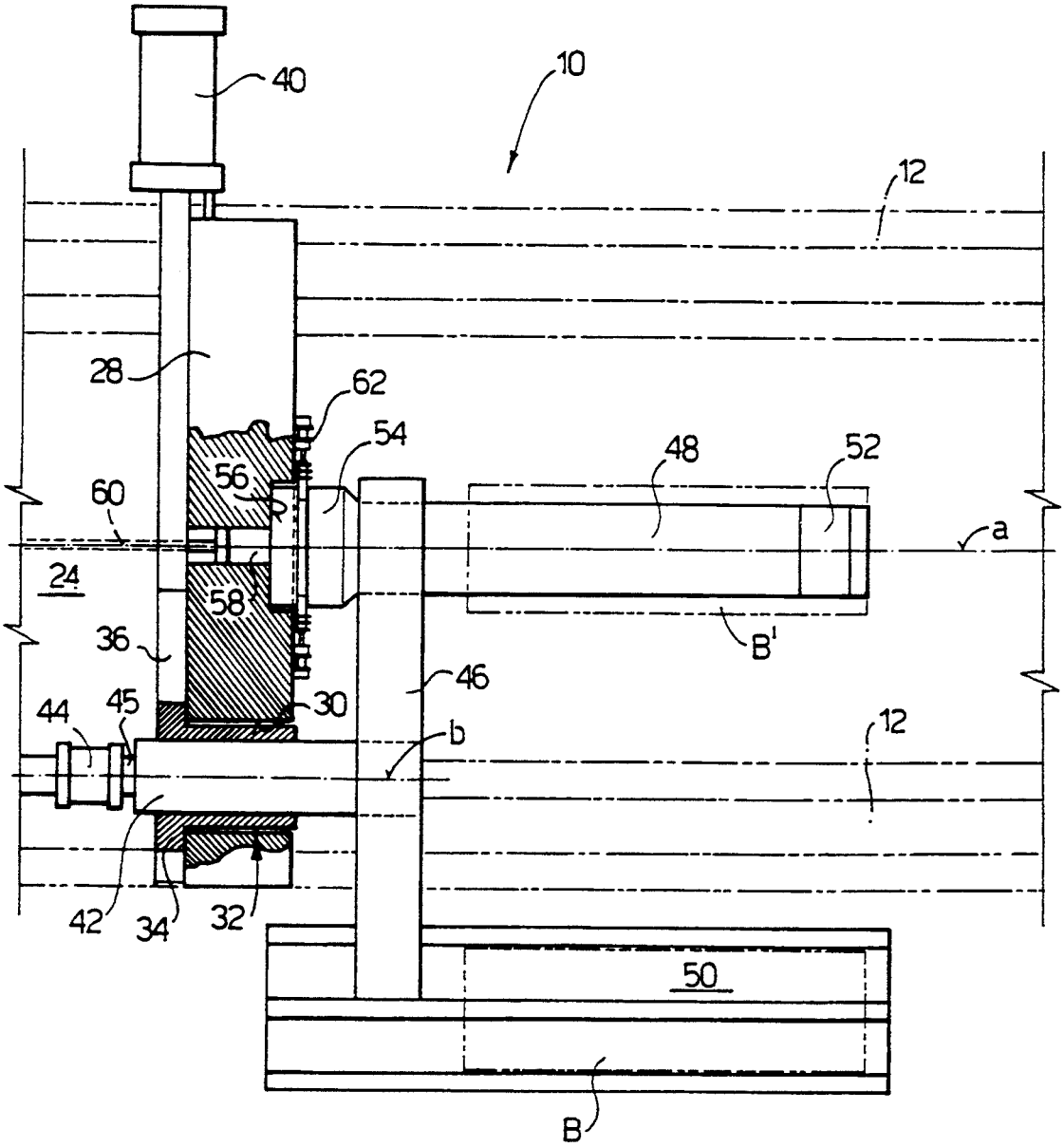
FIG. 2 is a partially sectional plan view of a detail of the press in FIG. 1, enlarged with respect to FIG. 1; the columns of the press are drawn with a broken line.
Figure 3:
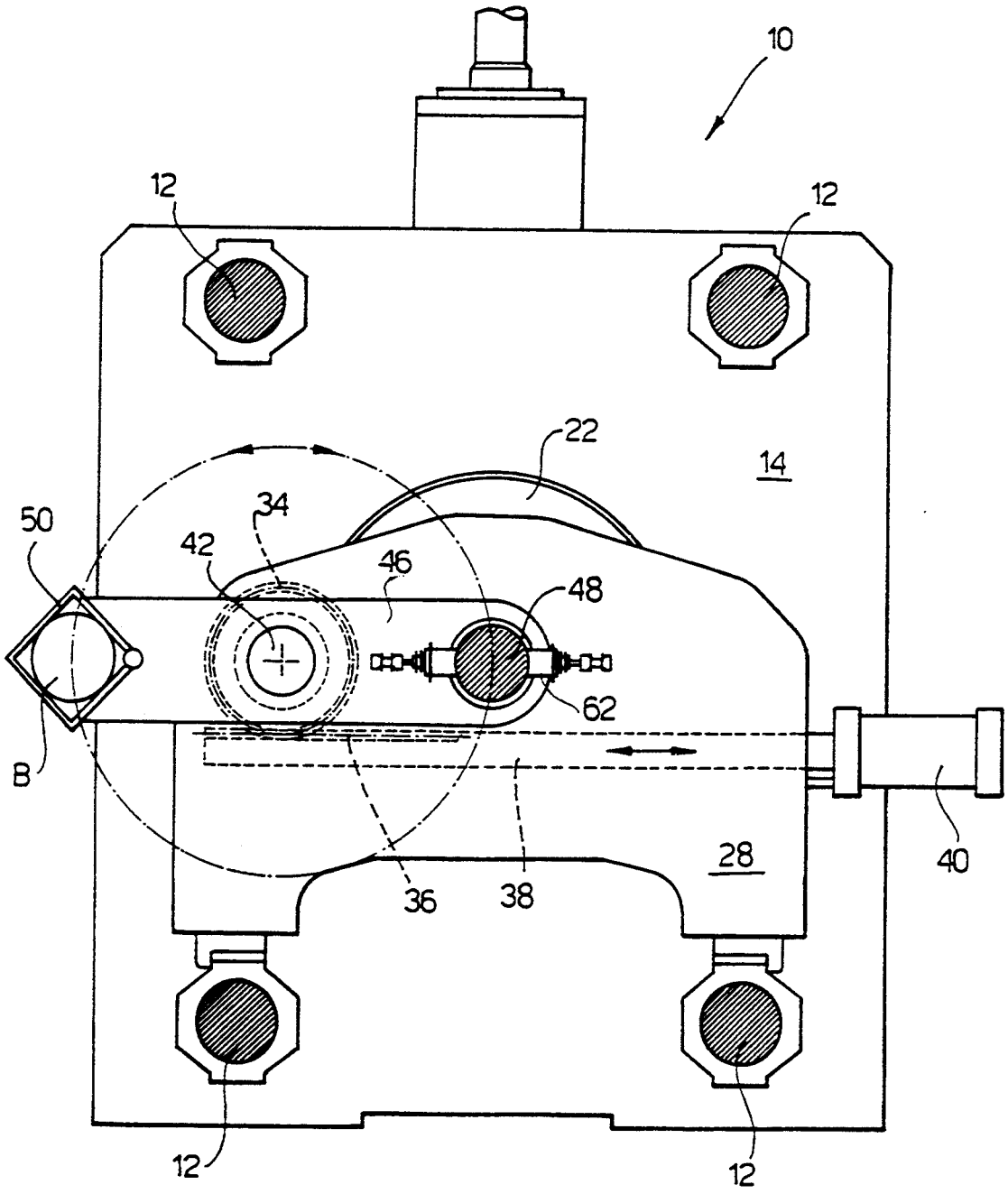
FIG. 3 is a sectional view along 3—3 in FIG. 1.

The arm 46 in FIGS. 1–3 is shown with the loader in position for receiving a billet, located outside the press and side by side with it; the plunger 48 is in the working position aligned on the axis a. A billet B is drawn in dash-dot lines, on the loader 50 and a billet B′ is drawn in dash-dot lines in the position which it assumes when it is on the axis a.

The arm is shown as rectilinear in the drawings; in this way a rotation through 180° from the position illustrated in FIG. 3 transfers the billet B onto the axis a and the plunger to a rest or maintenance position on the same side of the press, where the billet has been loaded. A rotation through 180° in the opposite direction transfers the loader once more to the position for receiving the billet and the plunger onto the axis a. However arm 28 could have an angular form, so that the transfer takes place through arcs of less than 180°.

Figure 4:
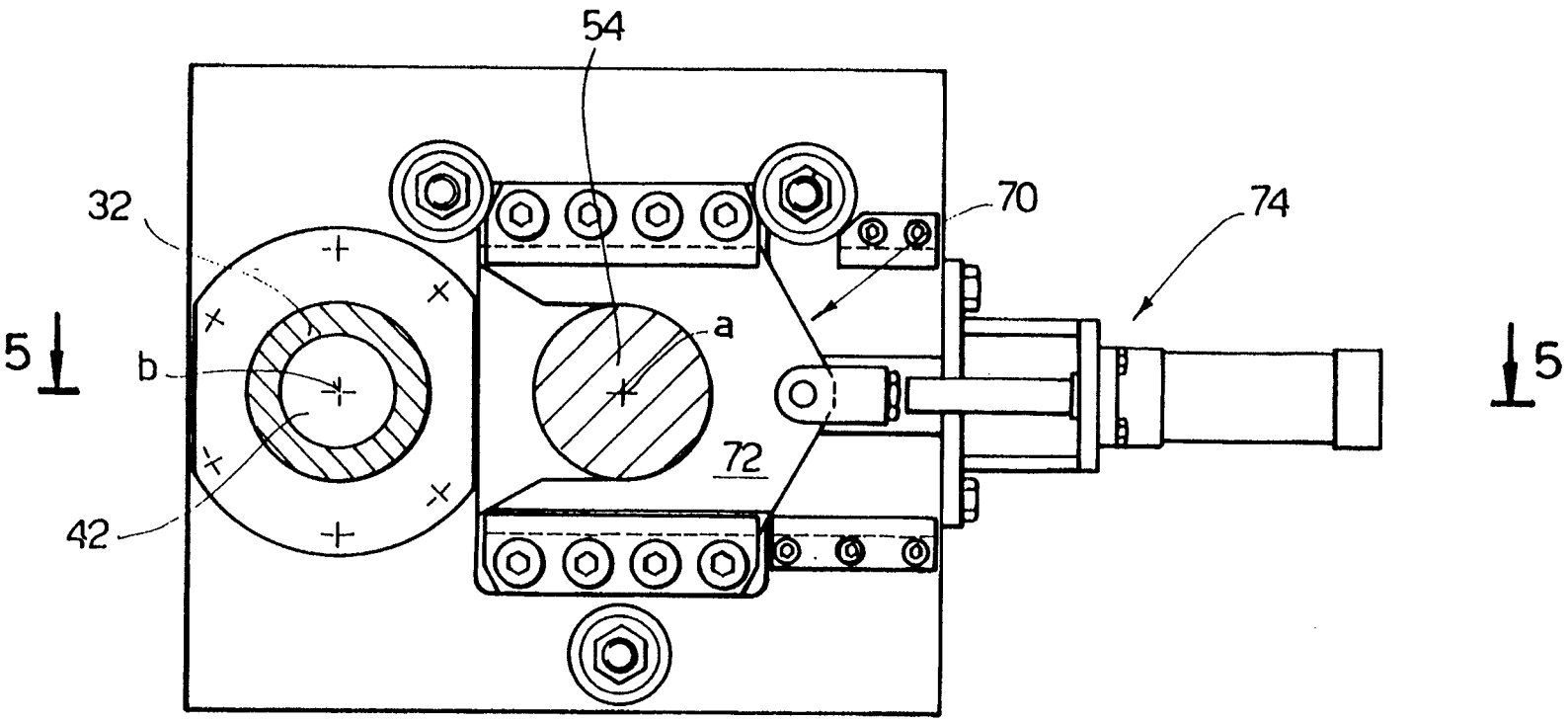
FIG. 4 is a sectional view along 4—4 in FIG. 1, showing a further embodiment of locking means for the plunger foot.
Figure 5:
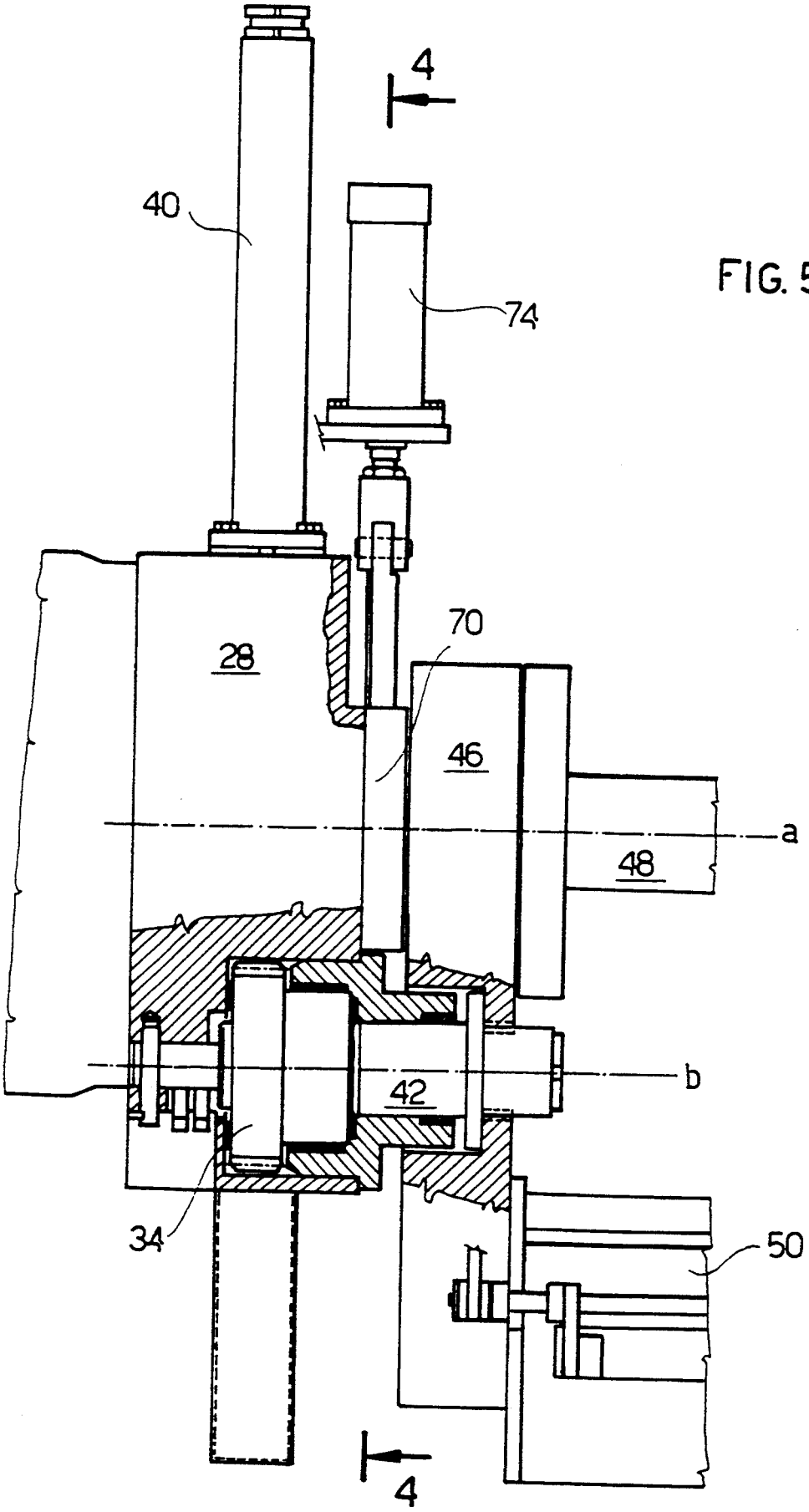
FIG. 5 is a sectional view along 5—5 in FIG. 4.

FIGS. 4, 5 show a further embodiment of the press with a different locking device for the plunger foot 54, referenced 70 as a whole. Locking device 70 comprises a fork-like locking member 72, which is movable between a locking position (shown in FIG. 4) and an unlocking position (not shown) under control of a cylinder-piston unit 74 carried on cross member 28.

Figure 6:
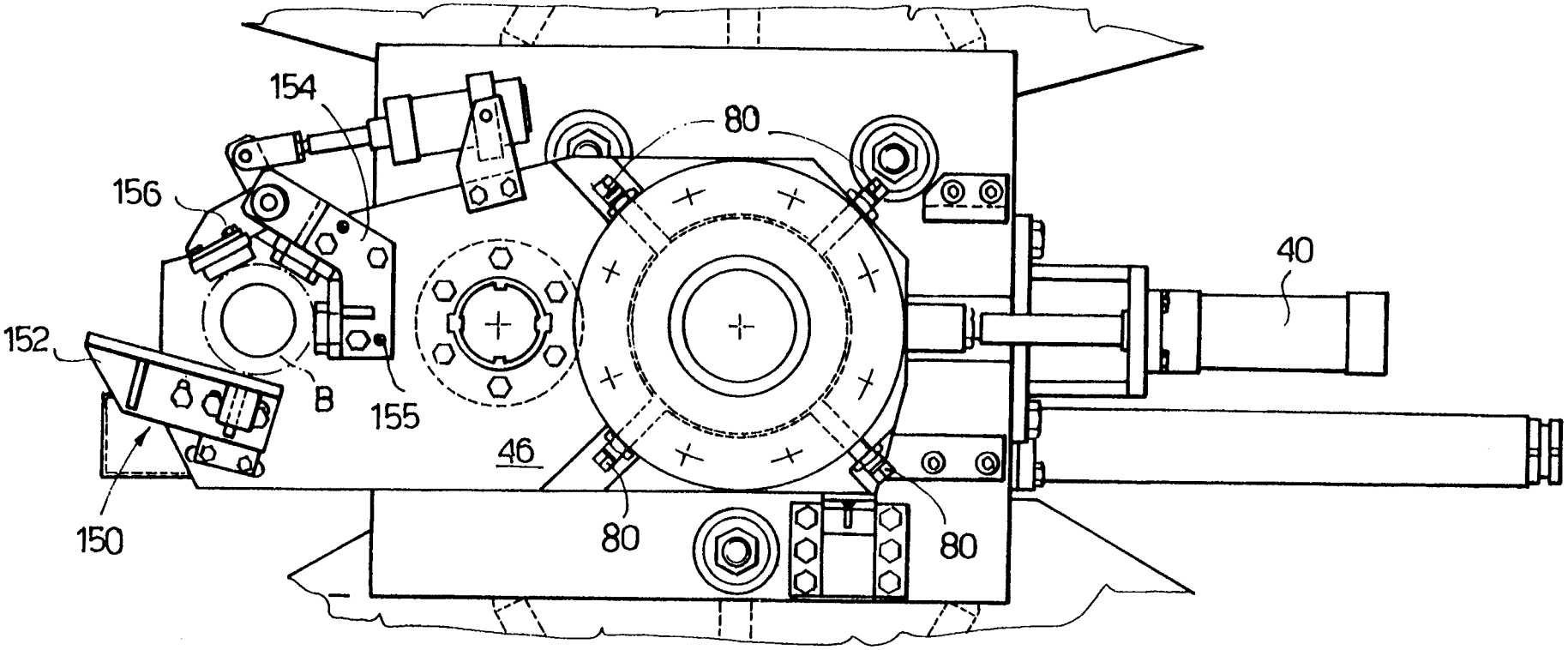
FIG. 6 is a detailed view similar to FIG. 3, of a modified embodiment.

In the locking position, the arms of member 72 engage a circumferential slot of said foot FIG. 6 shows a further modified embodiment of the extrusion press (the same reference numbers refer to similar parts throughout the various figures) wherein a device is provided for an axial adjustment o the plunger, said device comprising four radial screws 80 operating on a plunger carrying bush. In this way it is possible to compensate the plunger possible radial runouts due to the termal expansion .

In the same figure a loader 150 is shown as comprising an inclined base 152 and an adjustable jaw 154; said jaw comprises a first member pivoted at 155 on transverse arm 46 and second member 156, pivoted on the first member and locked to it at a selected angular position by per se known means 157.

Said adjustable jaw may be readily adjusted according to the diameter of the billet.

A description of the process and press operation is given below.

In the condition shown in the figures, the loader 50 is in its rest or maintenance position outside the structure and plunger 48 is positioned along the axis a with its foot 54 resting against the seat 56, preferably locked by locking device 62, or locking device 70.

Ram 24 drives cross member or beam 28, arm 46 and plunger 48 for a working stroke (towards the right in FIGS. 1, 2). Plunger 48 extrudes a billet (not shown), previously positioned in the container cavity, across an extrusion die in the die holder 20.

When the plunger is at a position almost completely extended into the container, a billet B begins to be loaded onto the loader 50, being transferred thereto from a carriage ( not shown) moving parallel to axes a, b and at the same speed as the plunger.

Then a return stroke of plunger 48, arm 46 and cross member 28 is operated through side cylinders 26.

Cylinder 44 moves the foot 54 of the plunger away from the relative seat or housing 56, in order to allow arm 46 to rotate.

The cylinder 40 operates rack 36 for rotating arm 46, for example through 180° as already stated, thus bringing the plunger to the side of the press and the billet-carrying loader along axis a.

The small piston or pusher 60 pushes the billet B into the container cavity while the operator can carry out necessary maintenance operations on the plunger.

A subsequent stroke of the rod 38 of the cylinder 40, in the opposite direction to the previous stroke, rotates the pin through 180° in the opposite direction and brings back the arm 46 with the loader and the plunger into the position shown in the figures.

It should be noted that in the rest position the plunger is positioned on the same side of the press on which the billets are loaded.

I claim:

1. An extrusion press comprising, on a fixed structure (12, 14, 15), a cross member (28) which is movable along a longitudinal or extrusion axis (a) of the press, a cylinder assembly (22) for driving the cross member; a container (16) having an axial cavity for receiving a billet to be extruded; a die holder slide (48) characterized in that it also comprises an arm (46) pivotally carried on the said cross member (28), said arm carrying a plunger (48) and a billet loader (50) spaced out from each other, the said arm (46) being rotatable between a condition in which it locates the plunger in a working position on the extrusion axis a of the press and the loader (50) in a position for receiving the billets on one side of the press, and a condition in which it locates the loader in a position on the extrusion axis (a) of the press and the plunger in a rest position on the said side of the press.

2. A press according to claim 1, characterized in that the said arm is rotatable around an axis (b) parallel with the extrusion axis (a) of the press.

3. A press according to claim 1, characterized in that the said cross member (28) comprises a supporting seat (56) for a foot (54) of the plunger (48), the said seat being centred on the axis (a) of the press, the said arm (46) being carried on the said cross member (28) and being longitudinally traversable for a short length thereon.

4. A press according to claim 3, characterized in that the said cross member further comprises a through hole (58) on the axis (a) and a small piston or pusher (60) cooperating with said hole for loading the billets in the container cavity.

5. A press according to claim 3, characterized in that it comprises locking means (62; 70) for the foot of the plunger.

6. A press as in claim 5, characterized in that said locking means comprise a pin cooperating with a through hole of said foot.

7. A press as in claim 5, characterized in that said locking means comprise a fork-like member (72) engageable in a circumferential slot of the plunger foot.

8. A press according to claim 1, characterized in that said transverse arm (46) is carried on a pin (42), which is axially slidable into but rotationally integral with a bush (32), said bush is in turn received in a rotatable manner in the mobile cross member (28), the bush being integral with a crown gear (34) which engages with a rack (36) carried on the cross member and movable on it in a direction transverse to the axis (9) of the press.

9. A process for carrying out billet extrusion on a short-stroke extrusion press, comprising the following steps:

a) positioning a billet to be extruded along the extrusion axis of the press, by means of a loader b) pushing said billet into a container cavity by means of a pusher c) extruding said billet by means of a plunger d) loading a further billet on a loader a') positioning said further billet along the extrusion axis characterized in that said extruding steps and said loading step are carried out simultaneously; and e) rotating an arm carrying said plunger and loader, between said steps b) and c) and between said steps d) and a').

* * * * *